US005286587A

United States Patent [19]

Ashiya

[11] Patent Number: 5,286,587

[45] Date of Patent: Feb. 15, 1994

[54] ELECTROPHOTOGRAPHIC PHOTORECEPTOR AND PROCESS FOR PRODUCING THE SAME

[75] Inventor: Seiji Ashiya, Minami-ashigara, Japan

[73] Assignee: Fuji Xerox Co., Ltd., Tokyo, Japan

[21] Appl. No.: 836,383

[22] Filed: Feb. 18, 1992

[30] Foreign Application Priority Data

Feb. 19, 1991 [JP] Japan ..... 3-045445

[51] Int. Cl.[5] ..... G03G 5/047

[52] U.S. Cl. ..... 430/58; 430/59; 430/128

[58] Field of Search ..... 430/58, 128, 133, 59

[56] References Cited

U.S. PATENT DOCUMENTS

| | | | |
|---|---|---|---|
| 4,731,312 | 3/1988 | Kato et al. | 430/128 X |
| 4,925,760 | 5/1990 | Baranyi et al. | 430/128 X |
| 4,952,471 | 8/1990 | Baranyi et al. | 430/128 X |

OTHER PUBLICATIONS

Melnyk, "Coating Process for Layered Photo-Receptor", Xerox Discl. Jour., vol. 17, No. 1, Jan./Feb. 1992, pp. 45–46.

G. T. Byrnes, R. P. Linstead, and A. R. Lowe, *J. Chem. Soc.*, p. 1017 (1934).

*Primary Examiner*—Roland Martin

*Attorney, Agent, or Firm*—Oliff & Berridge

[57] ABSTRACT

An electrophotographic photoreceptor comprising a conductive substrate having thereon at least a charge generating layer and a charge transporting layer is disclosed, in which said charge generating layer is a deposited film of a subliming organic pigment and has an iron content of not more than 100 ppm and a sulfur content of not more than 500 ppm. The electrophotographic photoreceptor has high photosensitivity, high chargeability, small dark decay, low residual potential, and excellent durability.

15 Claims, 1 Drawing Sheet

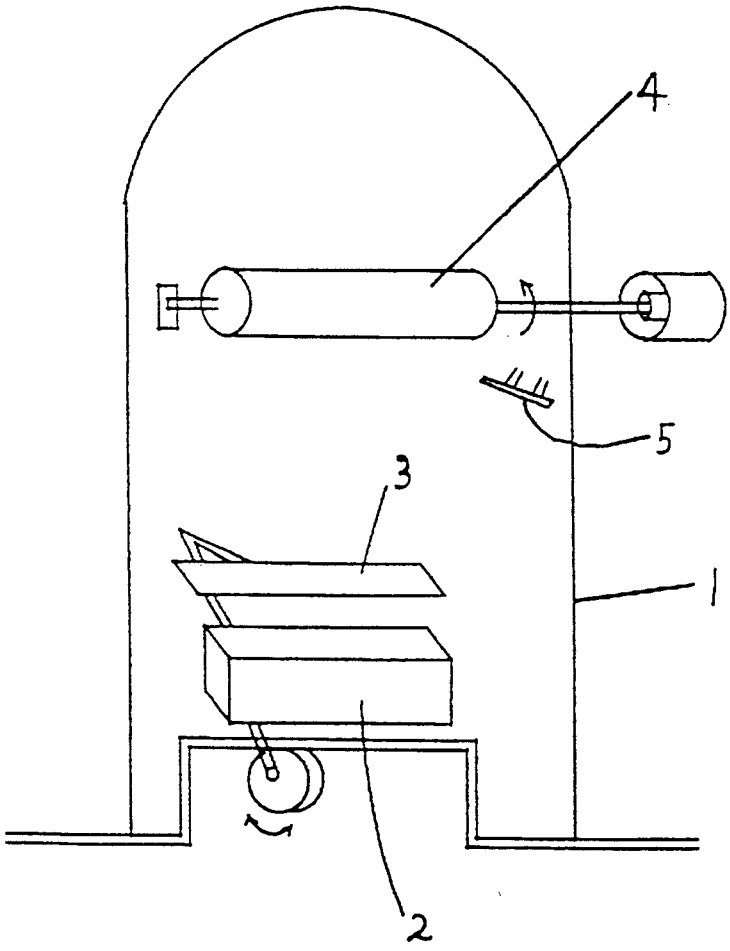
4
5
3
1
2

ELECTROPHOTOGRAPHIC PHOTORECEPTOR AND PROCESS FOR PRODUCING THE SAME

FIELD OF THE INVENTION

This invention relates to an electrophotographic photoreceptor containing an organic pigment as a photoconductive substance and, more particularly to a separate function type electrophotographic photoreceptor having a charge generating layer and a charge transporting layer.

BACKGROUND OF THE INVENTION

Electrophotographic photoreceptors using an organic pigment as a photoconductive substance are being given much study for further developments because of their advantages over those using inorganic substances from the standpoint of easy processing of materials, a wide choice of materials, low cost, and freedom from necessity of recovery.

The organic photoreceptors include those comprising a photoconductive compound and a sensitizer, those comprising a photoconductive compound of charge transfer complex type, and those having a charge generating layer and a charge transporting layer, called separate function type photoreceptors. The separate function type photoreceptors are now taking the lead among organic photoreceptors on the market because of a wide choice of materials allowed and ease in designing of devices.

Methods for forming a charge generating layer of the separate function type photoreceptors are generally divided into a coating method comprising coating an organic pigment dispersion in a binder resin on a substrate and a deposition method comprising forming a thin deposit on a substrate by vacuum deposition.

However, in a resin dispersion type charge generating layer formed by the coating method, movement of charge carriers generated in the organic pigment particles is hindered by resin molecules among the pigment particles, resulting in impairment of photoconductivity essentially possessed by the pigment, thus failing to exhibit satisfactory sensitivity. On the other hand, containing no binder resin, a deposited charge generating layer formed by the deposition method does not suffer from such a hindrance to charge carrier movement and exhibits satisfactory photoconductivity, giving an assurance of high sensitivity. However, the state-of-the-art electrophotographic photoreceptors having the deposited charge generating layer are still unable to sufficiently satisfy other performance characteristics required, such as high chargeability, small dark decay, low residual potential, and durability, e.g., potential stability on repeated use.

It is known that impurities contained in organic pigments have influences on electrophotographic characteristics of electrophotographic photoreceptors. In the case of the resin dispersion type charge generating layer, electrophotographic characteristics are maintained within a given range on an account of the presence of impurities in the organic pigment used. Therefore, organic pigments purified by general techniques or commercially available organic pigments can be used as they are. However, if such organic pigments are employed as a source of evaporation in the formation of a deposited charge generating layer, electrophotographic characteristics of the resulting electrophotographic photoreceptor vary to a large extent and are deteriorated. While it is thus highly necessary to control impurities in the organic pigments for use as an evaporation source, the impurity control alone is not sufficient for assuring stable electrophotographic characteristics.

SUMMARY OF THE INVENTION

An object of the present invention is to provide an electrophotographic photoreceptor having high photosensitivity, high chargeability, small dark decay, low residual potential, and excellent durability.

Another object of the present invention is to provide a process for producing such an electrophotographic photoreceptor.

The present invention relates to an electrophotographic photoreceptor comprising a conductive substrate having thereon at least a charge generating layer and a charge transporting layer, in which said charge generating layer is a deposited film of a sublimable organic pigment and has an iron content of not more than 100 ppm and a sulfur content of not more than 500 ppm.

In a preferred embodiment of the production of the photoreceptor, vacuum deposition for formation of a charge generating layer is carried out in such a manner that a given amount of the sublimable organic pigment is left non-evaporated in an evaporation source (evaporation boat).

In a second preferred embodiment of the production of the photoreceptor, vacuum deposition for formation of a charge generating layer is carried out in such a manner that the initial vapor of the subliming organic pigment is prevented from reaching the conductive substrate by using a shutter in the initial stage of deposition.

BRIEF DESCRIPTION OF THE DRAWING

The Figure illustrates a vacuum deposition apparatus to be used in the present invention.

DETAILED DESCRIPTION OF THE INVENTION

The electrophotographic photoreceptor according to the present invention can be produced by depositing a subliming organic pigment on a conductive substrate to form a charge generating layer and forming thereon a charge transporting layer, or by forming the charge transporting layer on the substrate and then forming a charge generating layer thereon.

Any known conductive substrate can be used in the present invention.

If desired, a subbing layer may be provided on a conductive substrate. Materials for forming a subbing layer are conventional and include polyvinyl butyral, silane coupling agents, organozirconium compounds, polyvinylpyridine, polyvinyl pyrrolidone, phenol resins, polyvinyl alcohol, poly-N-vinylimidazole, polyethylene oxide, ethyl cellulose, methyl cellulose, ethylene-acrylate copolymers, casein, polyamide, glue, and gelatin. The subbing layer-forming material is coated as dissolved in an appropriate solvent on a conductive substrate usually to a dry thickness of from 0.2 to 2 μm.

The charge generating layer according to the present invention comprises a deposited film of a sublimable organic pigment. It is required that the charge generating layer should have a sulfur content of not more than 500 ppm and preferably not more than 100 ppm. The terminology "sulfur content" as used herein includes not only sulfur impurities, either in a free form or in a compound form, but also the sulfur atom possessed by the pigment molecule per se. If the sulfur content of the charge generating layer exceeds 500 ppm, the resulting electrophotographic photoreceptor would have a reduced chargeability and a decreased dark decay rate. A sulfur content is preferably determined by converting sulfur or sulfur compounds to $SO_2$ by combustion and quantitatively determining $SO_2$ by infrared absorption analysis. Commercially available analytical instruments are used for sulfur determination, for example, EMIA-510 type sulfur analyzing device manufactured by HORIBA, LTD. and LECO CHNS-932 type element analyzing device manufactured by Nippon Analyst Co., Ltd.

The charge generating layer is also required to have an iron content of not more than 100 ppm and preferably not more than 50 ppm. The terminology "iron content" as used herein includes both free iron and iron compounds present as impurities. If the iron content exceeds 100 ppm, the resulting photoreceptor would have reduced chargeability, reduced photosensitivity, and increased residual potential. Determination of iron contents can be made by atomic-absorption spectroscopy or ICP (plasma emission spectroscopy), using a commercially available analytical instruments, for example, SPS 1200A type multielement sequential ICP analyzing device manufactured by SEIKO INSTRUMENTS & ELECTRONICS LTD.

Deposition for forming a charge generating layer can be carried out by vacuum deposition according to a resistance heating method, an electron bombardment method, a radiofrequency induction heating method, etc. Conditions for vacuum deposition are: $10^{-4}$ to $10^{-7}$ Torr in degree of vacuum; 350° to 600° C. (preferably 450° to 500° C.) in evaporation source temperature; and room temperature to 100° C. (preferably room temperature to 50° C.) in conductive substrate temperature. In particular, the lower the conductive substrate temperature, the better, since it gives influences, though slight, on crystal properties of the deposited film. The above-mentioned range of the conductive substrate temperature is thus recommended.

In preferred embodiments of the present invention, vacuum deposition is performed in the following two manners.

(1) Not all of a subliming organic pigment as an evaporation source is evaporated. Namely, a part of the evaporation source is left non-evaporated.

(2) In the initial stage of vacuum deposition, a shutter is used in the vacuum deposition apparatus so as to prevent the initial vapor of a subliming organic pigment from reaching the conductive substrate.

In embodiment (1), the sublimable organic pigment is generally left non-evaporated in an amount of about $\frac{2}{3}$ to 1/20, preferably about $\frac{1}{2}$ to $\frac{1}{8}$, the initial weight of the evaporation source (i.e., the amount thereof before evaporation), whereby sulfur- or iron-containing impurities having a high sublimation temperature tend to remain in the residue of the evaporation source. The amount of the evaporation source to be left varies depending on properties of the pigments, purity thereof and the like. If the evaporation source is left too much, however, production cost of the photoreceptor increases and it is not economical. The optimum amount of the evaporation source to be left can be determined without difficulties.

Embodiment (2) can be carried out (i) by closing the shutter until the evaporation source is evaporated in an amount of about $\frac{1}{4}$ to $\frac{1}{8}$ the initial weight of the evaporation source and then opening the shutter; (ii) by closing the shutter for the initial period of about $\frac{1}{3}$ to 1/10 the whole evaporation time and then opening the shutter; or (iii) by heating, while closing the shutter, the evaporation source at the source temperature slightly lower then the sublimation temperature of the source (e.g., 80 to 90% of the sublimation temperature) to remove initial evaporation components containing large amounts of impurities from the evaporation source, followed by increasing the temperature to a predetermined evaporation temperature, and then opening the shutter, whereby the initial vapor of the sublimating organic pigment is prevented from being deposited on the substrate.

Embodiments (1) and (2) are preferably performed in combination, whereby impurities having both low and high sublimation temperatures can be prevented from being incorporated in the resulting charge generating layer.

The Figure illustrates a schematic view of the apparatus for carrying out vacuum deposition according to embodiments (1) or (2). In FIG. 1, resistance heating boat 2 made of graphite, tungsten, etc. is placed in vacuum chamber 1, and shutter 3 is movably set above boat 2. Conductive substrate 4 is rotatably set in the upper part of vacuum chamber 1, and plate 5 for analysis is set in vicinity of substrate 4.

When vacuum deposition is carried out under the above-described conditions, the resulting electrophotographic photoreceptor has uniform characteristics.

The charge generating layer has a thickness of from 0.01 to 3 μm, and preferably from 0.1 to 1 μm. If the thickness is less than 0.01 μm, light absorption of the charge generating layer decreases to reduce photosensitivity. If it exceeds 3 μm, heat-excited carriers in the charge generating layer increases, resulting in an increase in dark decay and a decrease in chargeability.

The sublimable organic pigments which can be used in the present invention may be any of those synthesized by general processes which may be purified by an acid pasting method, a sublimation method, an organic solvent-washing method and the like. The crystal structure of the subliming organic pigment is not limited. In order to satisfy the requirements that the charge generating layer must have an iron content of not more than 100 ppm and a sulfur content of not more than 500 ppm, it is desirable to previously reduce impurities contained in the subliming organic pigment to be used by (a) an acid pasting method and/or (b) a washing treatment.

Acid pasting of an organic pigment is conducted by dissolving an organic pigment in concentrated sulfuric acid and adding the pigment solution dropwise in water to re-precipitate the organic pigment. More specifically, 1 part by weight of an organic pigment is dissolved in at least 30 parts by weight of concentrated sulfuric acid, followed by stirring at 10° C. for 3 hours. The resulting solution is added dropwise in at least 200 parts by weight of water kept at 3° to 5° C. to precipitate the pigment. To use at least 200 times as much water as the solution by weight is important for controlling the sulfur content. The precipitate is collected by filtration and washed with water. It is important to use at least 1000 times as much water as the organic pigment by weight. The precipitate is then dried at 100° C. to reduce the water content to 0.1% or less by weight.

In the other treatment, washing treatment, an organic pigment is washed with an organic solvent (e.g., N-methylpyrrolidone, nitrobenzene, cellosolves, and phenols) acids, alkalis, pure water, deionized water and the like at a high temperature or using a Soxhlet's extractor. In case of using acids or alkalies, the washed pigment should be further washed with deionized water to substitute the acids or alkalis in the pigment with the deionized water. After washing, the thus treated pigment is preferably dried with heat or under vacuum.

Examples of sublimable organic pigments which can be used in the present invention are shown below.

i) Metallo- or metal-free phthalocyanine compounds of formula (I):

(I)

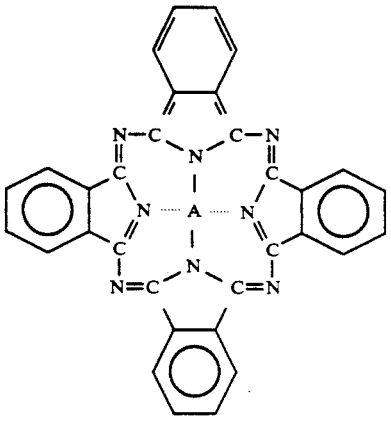

wherein A represents an atom or atomic group capable of covalent bonding or coordinate bonding to phthalocyanine.

The atom or atomic group capable of covalent bonding or coordinate bonding to phthalocyanine as represented by A includes elements of the groups IIa, IIIa, IVa, Va, VII, Ib, IIb, IIIb, IVb, and VIb of the periodic table, e.g., $H_2$, Li, Na, K, Cu, Ag, Au, Be, Mg, Ca, Bs, Zn, Cd, Hg, Al, Se, Ca, Y, In, Tl, Si, Ti, Ge, Zr, Sn, Hf, Pb, V, Nb, Sb, Ta, Cr, Mo, W, Mn, Te, Re, Co, Ni, Ru, Rd, Os, Ir, Pt, La, Ce, Pr, Nd, Pm, Sm, Fu, Cd, Tb, Dy, Ho, Er, Tm, Yb, Lu, Th, Pa, U, Np, and Am; and residues of compounds containing these elements, e.g., halides, and cyanides.

Specific examples of the phthalocyanine compounds of formula (I) are $H_2$-phthalocyanine, Cu-phthalocyanine, Fe-phthalocyanine, Co-phthalocyanine, Pb-phthalocyanine, VO-phthalocyanine, TiO-phthalocyanine, $TiCl_2$-phthalocyanine, and InCl-phthalocyanine.

These phthalocyanine compounds are synthesized by known processes disclosed, e.g., in G. T. Byrne, R. P. Linstead, and A. R. Lowe, *J. Chem. Soc.*, p. 1017 (193).

ii) Perylene compounds represented by formula (II) to (VI):

(II)

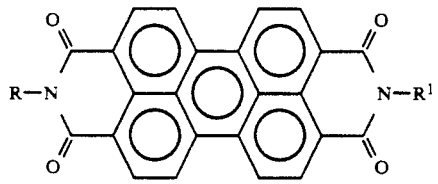

(III)

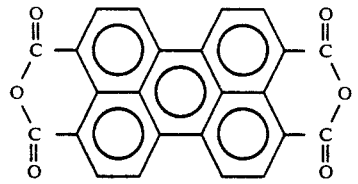

(IV)

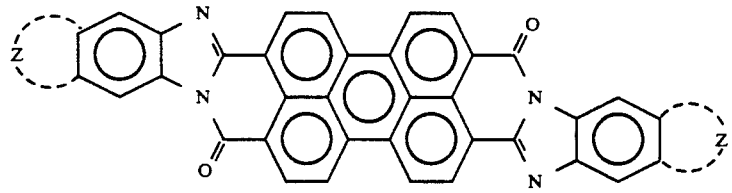

(V)

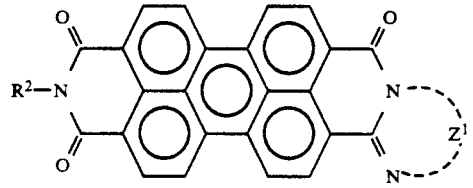

-continued (VI)

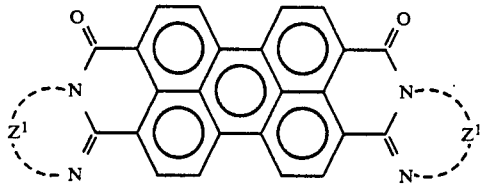

wherein R, $R^1$ and $R^2$, each represents a hydrogen atom, an alkyl group, an aryl group, or an aralkyl group; Z represents nothing or an atomic group necessary to form an aromatic ring; and $Z^1$ represents an atomic group necessary to form a heterocyclic ring.

Specific examples of the perylene compounds represented by formula (II) having the same groups for R and $R^1$ are tabulated below.

| Compound No. | C.I. Pigment (C.I. No.) | C.I. Vat | Pigment Name | R and $R^1$ |
|---|---|---|---|---|
| II-1 | R-123 (71145) | — | Perylene Vermilion | 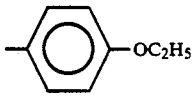 |
| II-2 | R-149 (71137) | — | Perylene Scarlet | 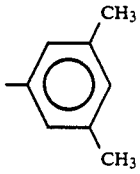 |
| II-3 | R-178 (71155) | — | Perylene Red 178 | 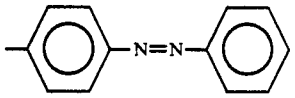 |
| II-4 | R-179 (71130) | R-20 | Perylene Maroon | $-CH_3$ |
| II-5 | R-189 (71135) | R-32 | Perylene Red 189 | 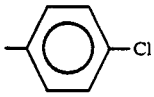 |
| II-6 | R-190 (71140) | R-29 | Perylene Red 190 | 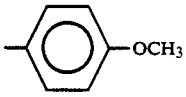 |
| II-7 | BR-26 (71129) | — | Perylene Bordeaux | $-H$ |

Other examples of the perylene compounds represented by formula (II) are tabulated below.

| Compound No. | R | $R^1$ |
|---|---|---|
| II-8 | 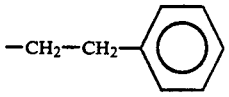 | 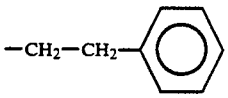 |
| II-9 | 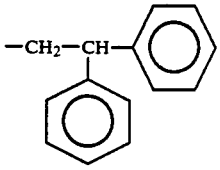 | 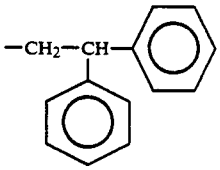 |

-continued
| Compound No. | R | $R^1$ |
|---|---|---|
| II-10 | $-CH_2-CH_2-$ 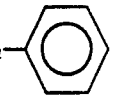 | 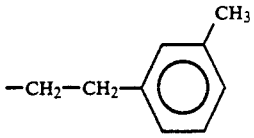 |
| II-11 | $-CH_2-CH_2-$ 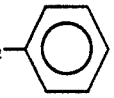 | $-CH_2CH_2CH_3$ |
| II-12 | $-CH_2-CH_2-$ 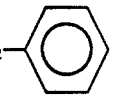 | 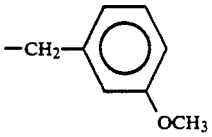 |
| II-13 | $-CH_2-CH_2-$ 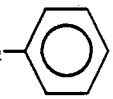 | $-CH_2CH_2CH_2OCH_3$ |
| II-14 | $-CH_2-CH_2-$ 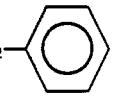 | $-H$ |
| II-15 | $-CH_2-CH_2-$ 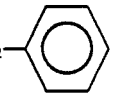 | 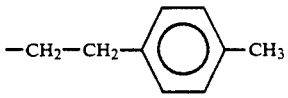 |
| II-16 | $-CH_2-CH_2-$ 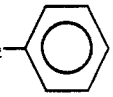 | $-CH_2CH_2OCH_3$ |
| II-17 | $-CH_2-CH_2-$ 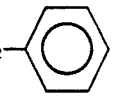 | $-CH_2CH_2CH_2SCH_3$ |
| II-18 | $-CH_2-CH_2-$ 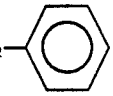 | 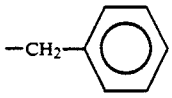 |
| II-19 | $-CH_2-CH_2-$ 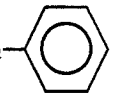 | 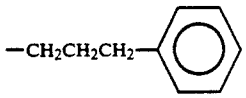 |
| II-20 | $-CH_2-CH_2-$ 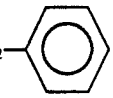 | 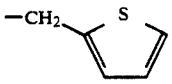 |
| II-21 | $-CH_2-CH_2-$ 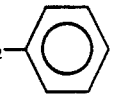 | 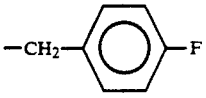 |
| II-22 | $-CH_2-CH_2-$ 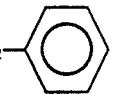 | 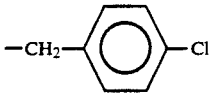 |

-continued
| Compound No. | R | $R^1$ |
|---|---|---|
| II-23 | $-CH_2-CH_2-$ 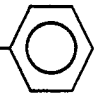 | $-CH(CH_3)-$ 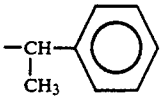 |
| II-24 | $-CH_2-CH_2-$ 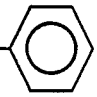 | $-CH_2-$ 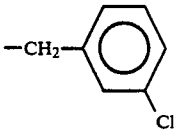 |
| II-25 | $-CH_2-CH_2-$ 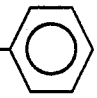 | $-CH_3$ |
| II-26 | $-CH_2-CH_2-$ 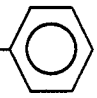 | 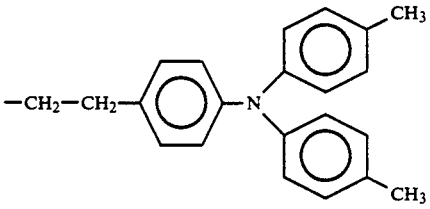 |
| II-27 | $-CH_2-CH_2-$ 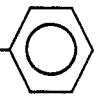 | 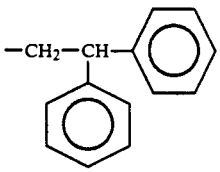 |
| II-28 | $-CH_2-CH_2-$ 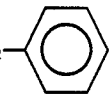 | 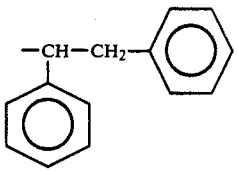 |
| II-29 | $-CH_2-CH_2-$ 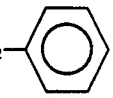 | 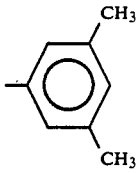 |
| II-30 | 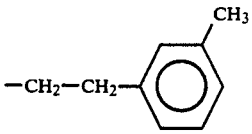 | $-CH_2CH_2CH_2OCH_3$ |
| II-31 | 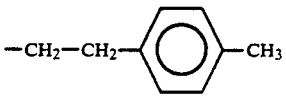 | $-CH_2CH_2CH_2OCH_3$ |
| II-32 | 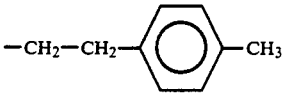 | 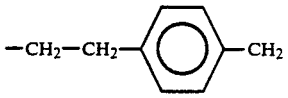 |

-continued
| Compound No. | R | $R^1$ |
|---|---|---|
| II-33 | 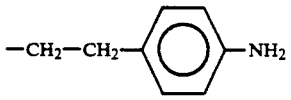 | 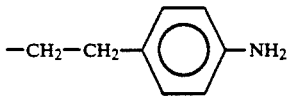 |
| II-34 | 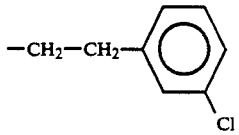 | 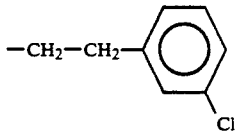 |
| II-35 | 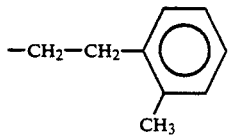 | 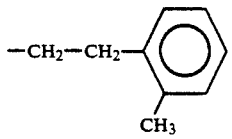 |
| II-36 | 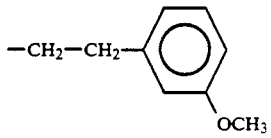 | 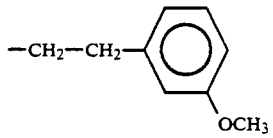 |
| II-37 | 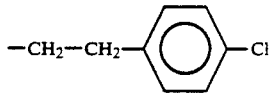 | 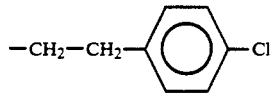 |
| II-38 | 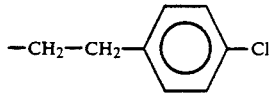 | 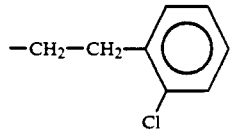 |
| II-39 | 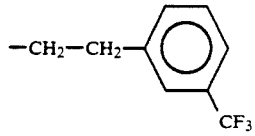 | 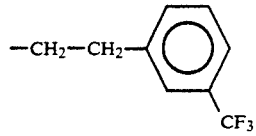 |
| II-40 | 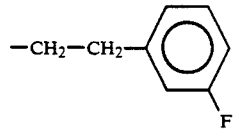 | 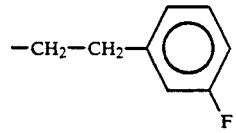 |
| II-41 | 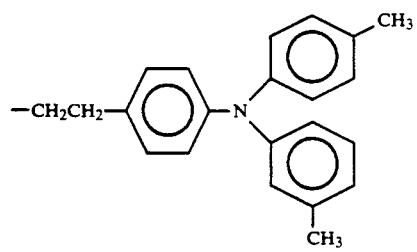 | 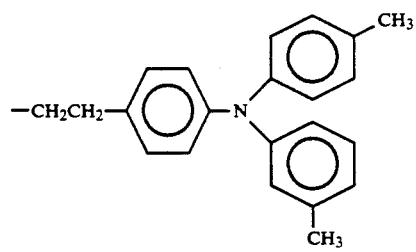 |
| II-42 | 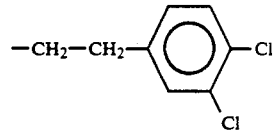 | 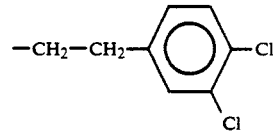 |

-continued
| Compound No. | R | $R^1$ |
|---|---|---|
| II-43 | 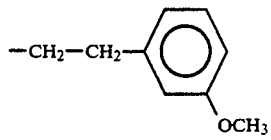 | 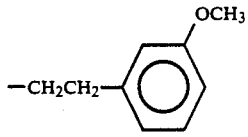 |
| II-44 | 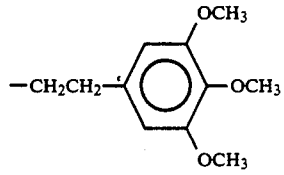 | 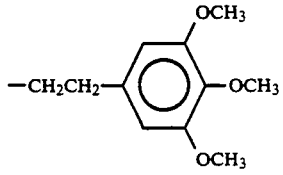 |
Specific examples of the perylene compounds represented by formula (V) are tabulated below.
| Compound No. | $R^2$ | $Z^1$ |
|---|---|---|
| V-1 | 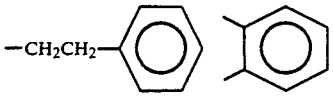 | |
| V-2 | 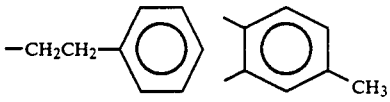 | |
| V-3 | 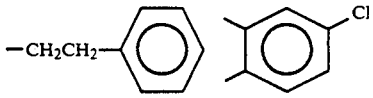 | |
| V-4 | 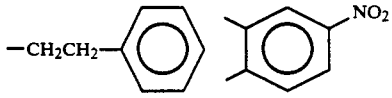 | |
| V-5 | 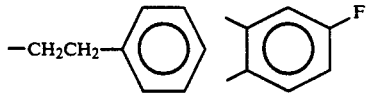 | |
| V-6 | 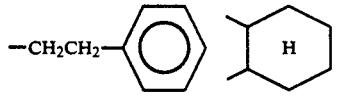 | |
| V-7 | 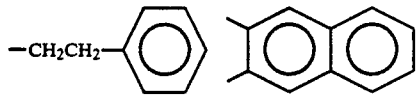 | |
| V-8 | 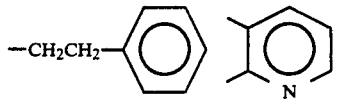 | |
-continued
| Compound No. | $R^2$ | $Z^1$ |
|---|---|---|
| V-9 | 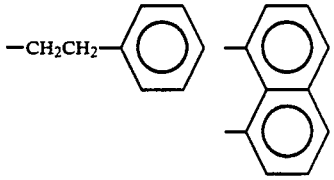 | |
| V-10 | 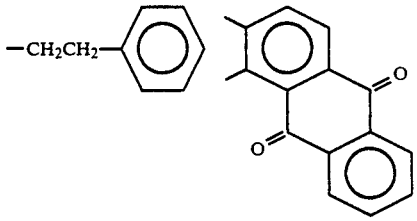 | |
| V-11 | 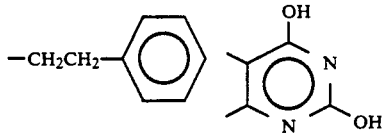 | |
| V-12 | 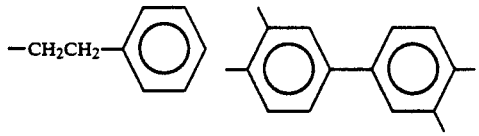 | |
| V-13 | 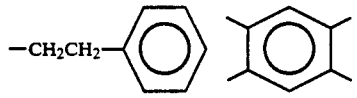 | |
Specific examples of the perylene compounds represented by formula (VI) are those having the groups for $Z^1$ as follows:
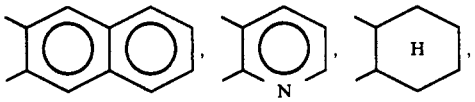

-continued

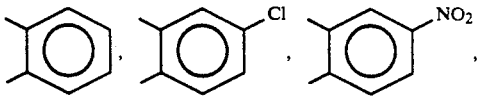

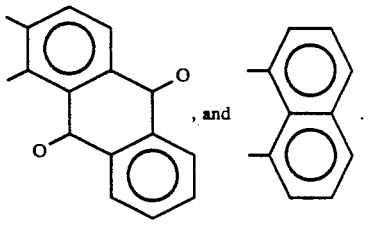

iii) Polycyclic quinone pigments represented by formulae (VII) to XI):

(VII)

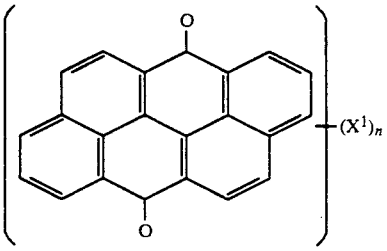

(VIII)

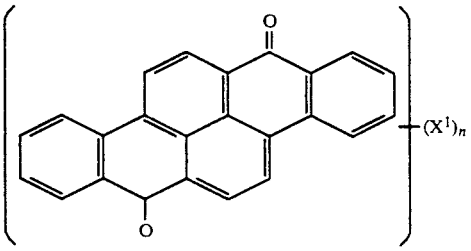

(IX)

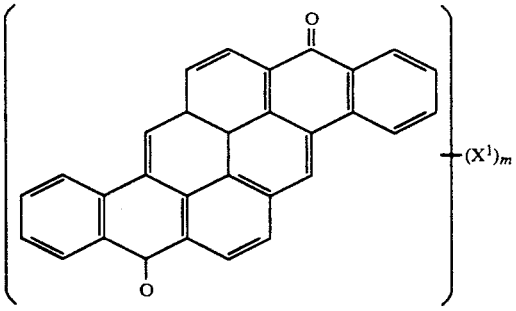

wherein $X^1$ represents a halogen atom, a nitro group, a cyano group, acyl group preferably having up to 6 carbon atoms, or a carboxyl group; n represents 0 or an integer of from 1 to 4; an m represents 0 or an integer of from 1 to 6.

Specific examples of the anthanthrone pigments represented by formula (VII) are shown below.

(VII-1)

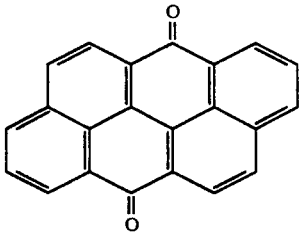

(VII-2)

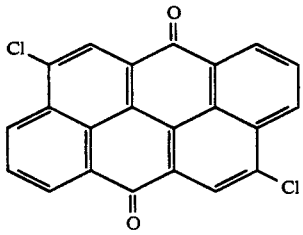

(VII-3)

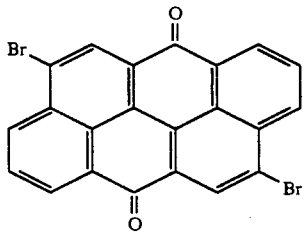

(VII-4)

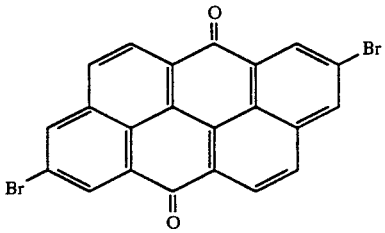

(VII-5)

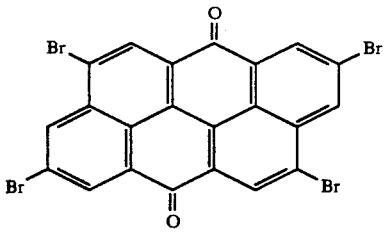

(VII-6)

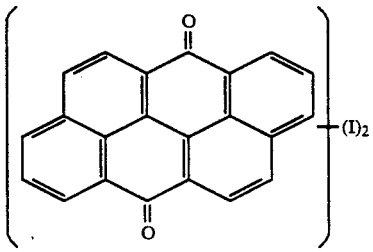

-continued
(VII-7)
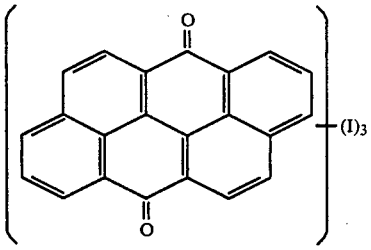
(VII-8)
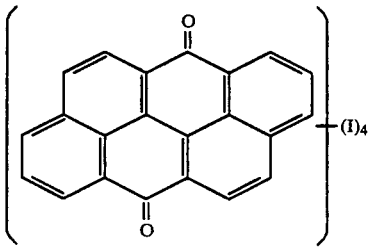
(VII-9)
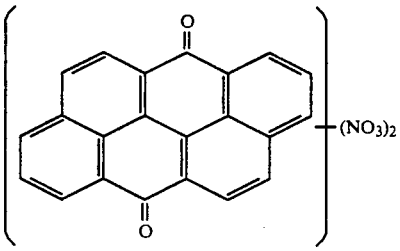
(VII-10)
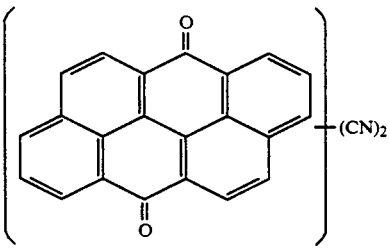
(VII-11)
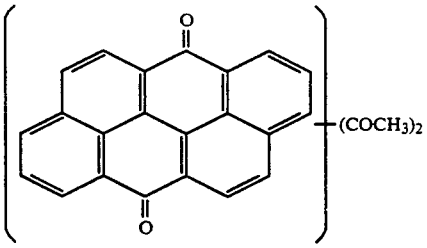
Specific examples of the dibenzopyrenequinone pigments represented by formula (VIII) are shown below.
(VIII-1)
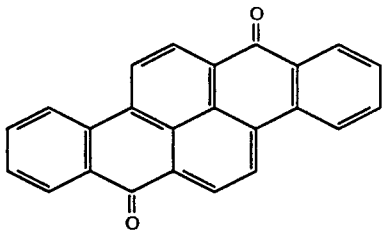
(VIII-2)
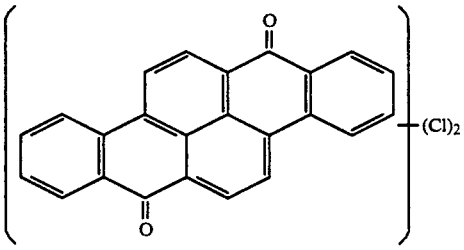
(VIII-3)
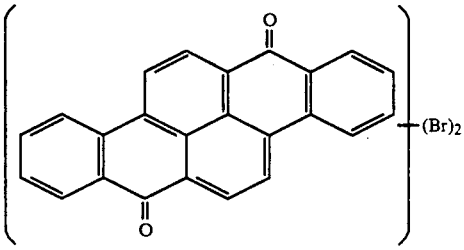
(VIII-4)
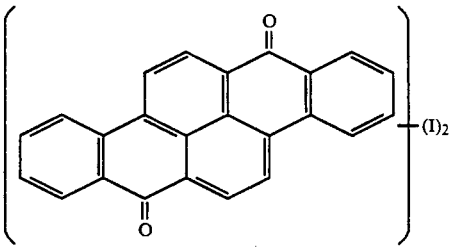
(VIII-5)
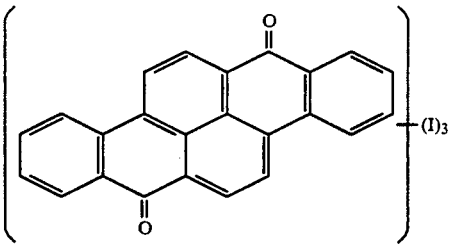
(VIII-6)
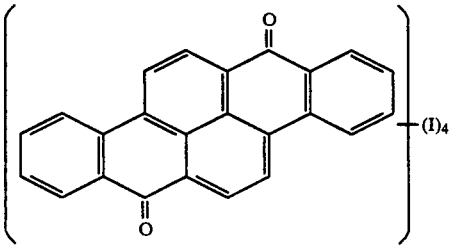

-continued
(VIII-7)
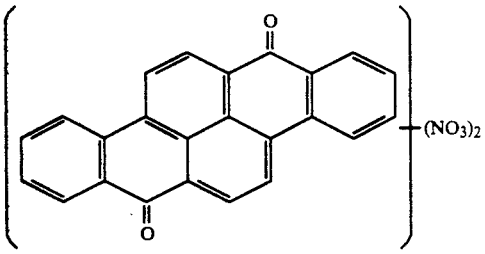
(VIII-8)
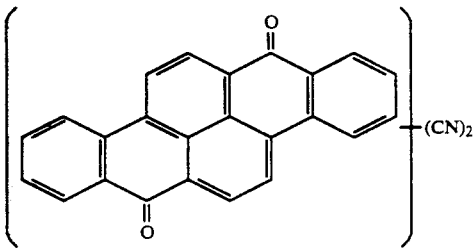
(VIII-9)
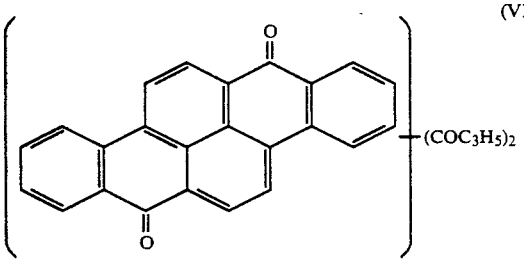
Specific examples of the pyranthrone pigments represented by formula (IX) are shown below.
(IX-1)
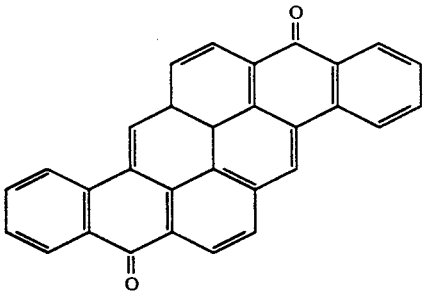
(IX-2)
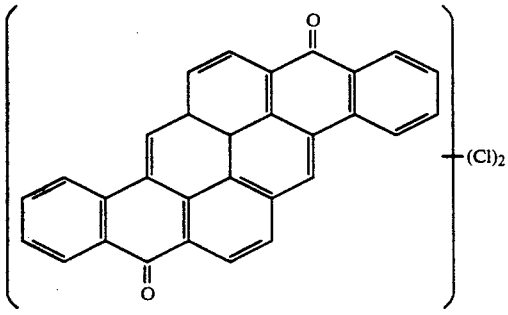
-continued
(IX-3)
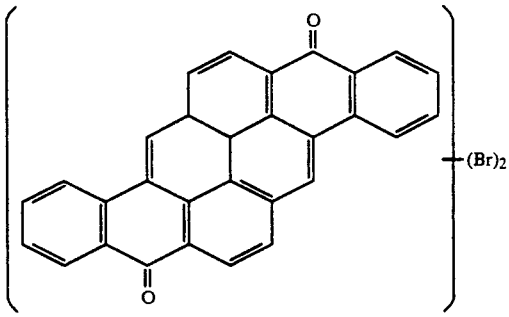
(IX-4)
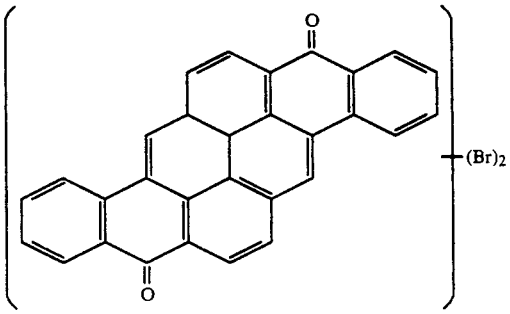
(IX-5)
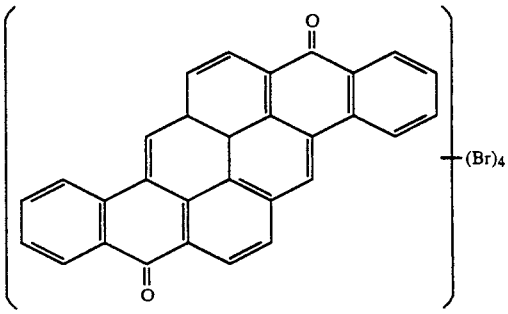
(IX-6)
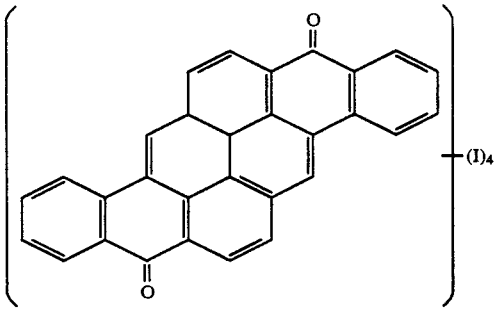
(IX-7)
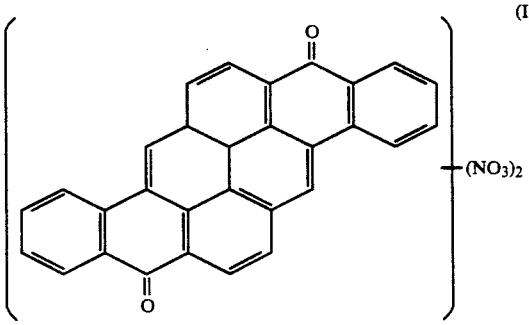

-continued (IX-8)

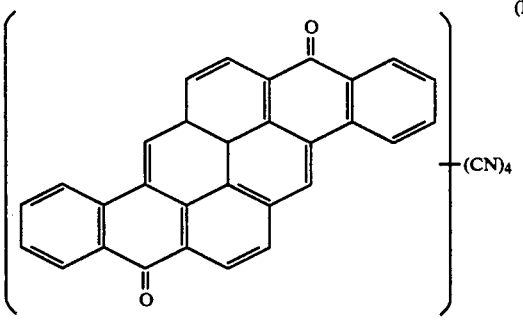

The charge transporting layer comprises a charge transporting material and a binder resin. Any of known charge transporting materials can be used. Examples of suitable charge transporting materials include polycyclic aromatic compounds, e.g., anthracene, pyrene, and phenanthrene; compounds having a nitrogen-containing heterocyclic ring, e.g., an indole ring, a carbazole ring, and an imidazole ring; pyrazoline compounds, hydrazone compounds, triphenylmethane compounds, triphenylamine compounds, benzidine compounds, enamine compounds, and stilbene compounds. In addition, film-forming photoconductive polymers, such as poly-N-vinylcarbazole, halogenated poly-N-vinylcarbazole, polyvinylanthracene, poly-N-vinylphenylanthracene, polyvinylpyrene, polyvinylacridine, polyvinylacenaphthlene, polyglycidyl carbazole, pyrene-formaldehyde resins, and ethylcarbazole-formaldehyde resins, may be used by themselves to form a charge transporting layer.

Binder resins to be used can be chosen from a wide range of insulating resins. Examples of suitable binder resins are polyvinyl butyral, polyarylate, polycarbonate, polyester, phenoxy resins, vinyl chloride-vinyl acetate copolymers, polyvinyl acetate, acrylic resins, polyacrylamide, polyamide, polyvinylpyridine, cellulose resins, urethane resins, epoxy resins, casein, polyvinyl alcohol, and polyvinyl pyrrolidone.

The above-described charge transporting material and binder resin are dissolved in an appropriate organic solvent and coated on a charge generating layer. A mixing weight ratio of charge transporting material to binder resin usually ranges from 5:1 to 1:5.

Solvents to be used in the preparation of a coating composition for a charge transporting layer include alcohols, e.g., methanol, ethanol, and isopropanol; ketones, e.g., acetone, methyl ethyl ketone, and cyclohexanone; amides, e.g., N,N-dimethylformamide and N,N-dimethylacetamide; dimethyl sulfoxides; ethers, e.g., tetrahydrofuran, dioxane, and ethylene glycol monomethyl ether; esters, e.g., methyl acetate and ethyl acetate; halogenated aliphatic hydrocarbons, e.g., chloroform, methylene chloride, dichloroethylene, carbon tetrachloride, and trichloroethylene; and aromatic hydrocarbons, e.g., benzene, toluene, xylene, monochlorobenzene, and dichlorobenzene.

Coating is performed by various techniques, such as dip coating, spray coating, spin coating, bead coating, wire bar coating, blade coating, roller coating, extrusion coating, and curtain coating.

Drying following coating is preferably effected first at room temperature to obtain dry touch and then under heating. Heating for drying is usually at 30° to 200° C. for 5 minutes to 2 hours either in still air or in an air flow. The charge transporting layer generally has a thickness of from 5 to 50 μm.

The present invention is now illustrated in greater detail by way of Examples, but it should be understood that the present invention is not deemed to be limited thereto. All the percents, parts, and ratios are by weight unless otherwise indicated.

EXAMPLE 1

1) Formation of Subbing Layer

An aluminum pipe having an outer diameter of 84 mm and a length of 360 mm was coated with an about 5% solution of a polyvinyl acetal resin having the following structure in n-propyl/water by dip coating to form a 0.5 μm thick subbing layer.

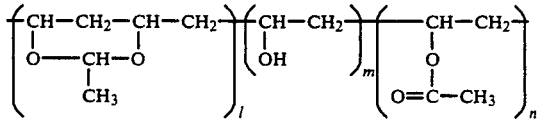

wherein l is 30 to 36 (mol %), m is 63 to 69 (mol %), and n is 0.5 to 3.0 (mol %).

2) Formation of Charge Generating Layer

The aluminum pipe having the subbing layer was set in a vacuum deposition apparatus shown in the Figure. Five grams of a pigment having the following formula was put in a resistance heating boat (evaporation source).

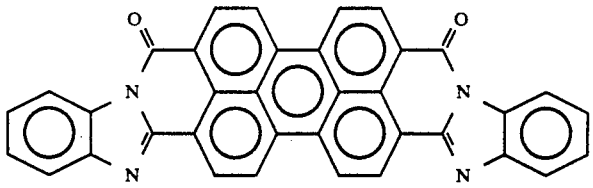

The degree of vacuum in the vacuum chamber was set at $10^{-5}$ Torr. With the aluminum pipe kept at room temperature without positive heating, an electrical current was passed through the resistance heating boat to perform vacuum deposition at an evaporation source temperature of 480° C. When vacuum deposition was continued for about 10 minutes, the shutter was moved to cover the evaporation source and, at the same time, heating was stopped. At this time, about one-half the initial weight of the pigment remained in the boat.

The pigment deposited on a plate for analysis which had previously been set in the vacuum deposition apparatus was collected, and its iron content and sulfur content were determined. The results obtained are shown in Table 1 below.

3) Formation of Charge Transporting Layer

In 20 parts of monochlorobenzene were dissolved 2 parts of N,N'-diphenyl-N,N-bis (3-methylphenyl)-[1,1-biphenyl]4,4'-diamine and 3 parts of poly(4,4-cyclohexylidenediphenylenecarbonate). The resulting coating composition was coated on the charge generating layer by dip coating, air-dried, and then dried by heating at 100° C. for 1 hour to form a 20 μm thick charge transporting layer.

4) Evaluation

The resulting electrophotographic photoreceptor was charged to −6.5 kV by means of a scorotoron discharger (grid voltage: −880 V) and exposed to light at an exposure amount adjusted to give a surface voltage on the surface of the photoreceptor (highlight voltage) of −150 V by means of a scanner for evaluation of electrical characteristics. Initial charged voltage ($V_O$), and residual voltage after uniform exposure for elimination of charges ($V_R$) were measured. After the above-described operation of charging and exposure was repeated 1000 times, $V_O$, surface voltage at the light-exposed area ($V_L$), and $V_R$ were measured. The results obtained are shown in Table 1.

EXAMPLE 2

1) Formation of Subbing Layer

| | |
|---|---|
| 50% Toluene solution of acetylacetonatotributoxy zirconium (ZC 540, produced by Matsumoto Kosho K.K.) | 100 parts |
| γ-Aminopropyltrimethoxysilane (A1110, produced by Nippon Unika K.K.) | 11 parts |
| Isopropyl alcohol | 440 parts |
| n-Butyl alcohol | 220 parts |

The above components were stirred with a stirrer to prepare a coating composition for a subbing layer. The composition was coated on the same aluminum pipe as used in Example 1 in the same manner as in Example 1, air-dried for about 3 minutes, and heated at 150° C. for 10 minutes.

2) of Charge Generating Layer

A charge generating layer was formed on the aluminum pipe set in the same vacuum deposition apparatus as in Example 1 using as an evaporation source 3 g of dibromoanthanthrone having been purified by acid pasting. While the evaporation source was covered with the shutter, the evaporation source temperature was kept at 300° C. for 5 minutes followed by gradually increasing the temperature to 375° C. over 5 minutes, and then the residue of the evaporation source was completely deposited on the aluminum pipe at that temperature over a period of about 30 minutes. The thus formed charge generating layer had a thickness of 0.4 μm.

3) Formation of Charge Transporting Layer and Evaluation

A charge transporting layer was formed on the charge generating layer in the same manner as in Example 1.

The resulting electrophotographic photoreceptor was evaluated in the same manner as in Example 1. The results obtained are shown in Table 1.

COMPARATIVE EXAMPLE 1

An electrophotographic photoreceptor was produced in the same manner as in Example 1, except that the amount of the pigment was changed to 3 g and the whole amount of the pigment was vacuum deposited to form an about 0.4 μm-thick charge generating layer. The results of evaluation are shown in Table 1.

COMPARATIVE EXAMPLE 2

An electrophotographic photoreceptor was produced in the same manner as in Example 2, except that the pigment was replaced with commercially available dibromoanthanthrone (Monolight Red 2Y, produced by ICI) and the whole amount of the evaporation source was deposited at 375° C. from the beginning. The results of evaluation are shown in Table 1.

EXAMPLE 3

1) Formation of Subbing Layer

In a mixed solvent comprising 50 parts of methanol, 20 parts of n-butanol, and 10 parts of water was dissolved 10 parts of an alcohol-soluble copolymer nylon resin (CM 8000, produced by Toray Industries, Inc.). The resulting coating composition was coated on the same aluminum pipe as used in Example 1 in the same manner as in Example 1, air-dried for 3 minutes, and then heated at 150° C. for 10 minutes.

2) Formation of Charge Generating Layer

Ten grams of titanylphthalocyanine whose $CuK_\alpha$ characteristic X-ray diffraction pattern shows at least one main peak at a Bragg angle (2θ) of 27.3°±0.2° were put in a resistance heating boat (evaporation source), and the degree of vacuum of the vacuum chamber was set at $10^{-5}$ Torr. With the aluminum pipe kept at room temperature without positive heating, an electrical current was passed through the resistance heating boat to perform vacuum deposition at an evaporation source temperature of 450° C. In order to prevent the initial vapor of the pigment in the initial stage of evaporation from reaching the aluminum substrate, the shutter above the evaporation source was kept closed for 2 minutes after the evaporation source temperature reached 450° C. Then, the shutter was opened, deposition onto the aluminum pipe conducted for about 6 minutes, and then the shutter closed to cover the evaporation source and, at the same time, the heating stopped. The thus formed charge generating layer had a thickness of 0.2 μm.

3) Formation of Charge Transporting Layer and Evaluation

A charge transporting layer was formed on the charge generating layer in the same manner as in Example 1. The resulting electrophotographic photoreceptor was evaluated in the same manner as in Example 1. The results obtained are shown in Table 1.

COMPARATIVE EXAMPLE 3

An electrophotographic photoreceptor was produced in the same manner as in Example 3, except that the amount of the pigment charged was changed to 4 g and that the whole amount of the pigment was evaporated and deposited on the aluminum pipe to form a 0.3 μm thick charge generating layer.

The resulting electrophotographic photoreceptor was evaluated in the same manner as in Example 1. The results obtained are shown in Table 1.

TABLE 1

| | Impurity Content | | Electrophotographic Characteristics | | | | |
|---|---|---|---|---|---|---|---|
| | | | 1st | | 1000th | | |
| Example No. | Iron (ppm) | Sulfur (ppm) | $V_O$ (-V) | $V_R$ (-V) | $V_O$ (-V) | $V_L$ (-V) | $V_R$ (-V) |
| Example 1 | 39 | 77 | 860 | 0 | 850 | 170 | 0 |
| Comparative Example 1 | 2500 | 1100 | 750 | 25 | 710 | 270 | 40 |
| Example 2 | 30 | 89 | 810 | 5 | 790 | 180 | 5 |
| Comparative Example 2 | 1300 | 650 | 780 | 20 | 750 | 260 | 35 |
| Example 3 | 90 | 450 | 820 | 50 | 810 | 200 | 55 |
| Comparative Example 3 | 150 | 630 | 790 | 60 | 700 | 210 | 95 |

As described and demonstrated above, the electrophotographic photoreceptor according to the present invention has high photosensitivity, high chargeability, small dark decays, low residual potential, and durability (e.g., potential stability on repeated use). According to the process of the present invention for producing an electrophotographic photoreceptor, impurity present in an organic pigment as an evaporation source can be controlled during vacuum deposition, thus making it possible to obtain stable electrophotographic characteristics even in using a commercially available organic pigment or a non-treated organic pigment.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having thereon at least a charge generating layer and a charge transporting layer, in which said charge generating layer is a vacuum deposited film of a sublimable organic pigment and has an iron content of not more than 100 ppm and a sulfur content of not more than 500 ppm.

2. The electrophotographic photoreceptor as in claim 1, wherein said charge generating layer has an iron content of not more than 50 ppm and a sulfur content of not more than 100 ppm.

3. The electrophotographic photoreceptor as in claim 1, wherein said sublimable organic pigment is selected from the group consisting of phthalocyanine compounds, perylene compounds, and polycyclic quinone pigments.

4. The electrophotographic photoreceptor as in claim 3, wherein said polycyclic quinone pigment is selected from the group consisting of anthanthrone pigments, dibenzopyrenequinone pigments, and pyranthrone pigments.

5. The electrophotographic photoreceptor as in claim 1, wherein said charge generating layer has a thickness of from 0.01 to 3 μm, and said charge transporting layer has a thickness of from 5 to 50 μm.

6. The electrophotographic photoreceptor as in claim 1, wherein a subbing layer is provided on the conductive substrate.

7. A process for producing an electrophotographic photoreceptor comprising a conductive substrate having thereon at least a charge generating layer and a charge transporting layer, which includes at least a step of forming a charge generating layer having an iron content of not more than 100 ppm and a sulfur content of not more than 500 ppm on a conductive substrate by vacuum deposition of a sublimable organic pigment, wherein said vacuum deposition of said sublimable organic pigment is carried out in such a manner that a given amount of the sublimable organic pigment is left non-evaporated in an evaporation source.

8. The process as in claim 7, wherein said vacuum deposition of said sublimable organic pigment is carried out in such a manner that the sublimable pigment is left in an amount of about ⅔ to 1/20 the initial weight of the evaporation source.

9. The process, as, in claim 8, wherein said vacuum deposition of said sublimable organic pigment is carried out in such a manner that the sublimable pigment is left in an amount of about ½ to ⅛ the initial weight of the evaporation source.

10. A process for producing an electrophotographic photoreceptor comprising a conductive substrate having thereon at least a charge generating layer and a charge transporting layer, which includes at least a step of forming a charge generating layer having an iron content of not more than 100 ppm and a sulfur content of not more than 500 ppm on a conductive substrate by vacuum deposition of a sublimable organic pigment, wherein said vacuum deposition of said sublimable organic pigment is carried out in such a manner that the initial vapor of the subliming organic pigment is prevented from reaching the conductive substrate by using a shutter in the initial stage of deposition.

11. The process as in claim 10, wherein said vacuum deposition of a sublimable organic pigment as an evaporation source is carried out by closing the shutter until the evaporation source is evaporated in an amount of about ¼ to ⅛ an initial weight of the evaporation source, and then opening the shutter.

12. The process as in, claim 10, wherein said vacuum deposition of a sublimable organic pigment as an evaporation source is carried out by closing the shutter for an initial period of about ⅓ to 1/10 the whole evaporation time and then opening the shutter.

13. The process as in claim 10, wherein said vacuum deposition of a sublimable organic pigment as an evaporation source is carried out by heating, while closing the shutter, a evaporation source at the source temperature lower than a sublimation temperature of the evaporation source to remove initial evaporation components containing impurities from the evaporation source, raising the source temperature to a predetermined evaporation temperature, and then opening the shutter.

14. A process for producing an electrophotographic photoreceptor comprising a conductive substrate having thereon at least a charge generating layer and a charge transporting layer, which includes at least a step of forming a charge generating layer having an iron content of not more than 100 ppm and a sulfur content of not more than 500 ppm on a conductive substrate by vacuum deposition of a sublimable organic pigment, wherein said vacuum deposition of the sublimable organic pigment is carried out in such a manner that an initial vapor of the sublimable organic pigment is prevented from reaching the conductive substrate by using a shutter in an initial stage of deposition; and the vacuum deposition of the sublimable organic pigment is carried out in such a manner that a given amount of sublimable organic pigment is left non-evaporated in an evaporation source.

15. The method of claim 7, wherein an evaporation source temperature ranges from 450° C. to 500° C.

* * * * *